US005935753A

United States Patent [19]

Ohishi et al.

[11] Patent Number: 5,935,753

[45] Date of Patent: Aug. 10, 1999

[54] TONER AND DEVELOPER FOR ELECTROSTATIC LATENT IMAGE DEVELOPMENT AND IMAGE FORMING METHOD USING THE SAME

[75] Inventors: Kaori Ohishi; Chiaki Suzuki; Masahiro Takagi, all of Minami-ashigara, Japan

[73] Assignee: Fuji Xerox Co., Ltd., Tokyo, Japan

[21] Appl. No.: 09/136,891

[22] Filed: Aug. 19, 1998

[30] Foreign Application Priority Data

Aug. 21, 1997 [JP] Japan ..... 9-224687

[51] Int. Cl.[6] ..... G03G 9/08; G03G 13/16

[52] U.S. Cl. ..... 430/111; 430/125; 430/126

[58] Field of Search ..... 430/111, 125, 430/126

[56] References Cited

U.S. PATENT DOCUMENTS

| | | | |
|---|---|---|---|
| 5,470,687 | 11/1995 | Mayama et al. | 430/111 |
| 5,527,558 | 6/1996 | Daidoji et al. | 430/111 |
| 5,789,132 | 8/1998 | Mayama et al. | 430/111 |
| 5,804,351 | 9/1998 | Takano et al. | 430/111 |

FOREIGN PATENT DOCUMENTS

| | | |
|---|---|---|
| A-61-279864 | 12/1986 | Japan . |
| A-6-148926 | 5/1994 | Japan . |
| A-6-148941 | 5/1994 | Japan . |
| A-8-328312 | 12/1996 | Japan . |

*Primary Examiner*—Roland Martin
*Attorney, Agent, or Firm*—Oliff & Berridge, PLC

[57] ABSTRACT

A toner comprising toner particles comprising a binder resin and a colorant, wherein the toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side. The toner satisfying relationship (1) is suitable for use in an image forming apparatus adopting a cleanerless system, and the toner satisfying relationship (2) is suitable for use in an image forming apparatus adopting a blade cleaning system.

18 Claims, No Drawings

TONER AND DEVELOPER FOR ELECTROSTATIC LATENT IMAGE DEVELOPMENT AND IMAGE FORMING METHOD USING THE SAME

FIELD OF THE INVENTION

This invention relates to a toner and a developer for developing an electrostatic latent image in an electrophotographic process, an electrostatic recording process and the like, and also relates to an image forming method using the same.

BACKGROUND OF THE INVENTION

In an electrophotographic image formation process, an image is formed by developing an electrostatic latent image formed on a photoreceptor with a toner containing a colorant, transferring the toner image onto transfer paper, and fixing the toner with a heat roll, etc. The photoreceptor is cleaned for the next cycle of electrostatic image formation. Dry developers used in such electrophotography are divided into a one-component developer that is a toner itself comprising a binder resin having a colorant dispersed therein and a two-component developer comprising such a toner and a carrier mixed therewith. Upon carrying out copying operations using these developers, excellent fluidity, transportability, fixability, chargeability, transfer properties, and cleanability are required for ensuring process suitability.

To meet the demand for compact equipment for space saving, an image formation system in which a residual toner is recovered simultaneously with development to omit a cleaning step has been proposed recently (hereinafter referred to as a "cleanerless system") (see JP-A-5-94113, the term "JP-A" as used herein means an "unexamined published Japanese patent application"). This system has the disadvantage that the recovered toner is different from the other part of the toner in charging characteristics so that it is not transferred and remain in the developing unit. Therefore, the cleanerless system has been demanded to have improved transfer efficiency.

Separately, it has been proposed to make toner particles almost spherical in order to improve the fluidity, chargeability, and transfer properties. However, use of spherical or nearly spherical toner particles causes the following problems. A developing unit is equipped with a transport control plate, and the amount of a developer to be transported can be controlled by adjusting the distance between the transport control plate and a magnetic roll. The problem is that the rate of the change in the transported developer amount to the change in the distance between the magnetic roll and the transport control plate for adjusting the transported developer amount increases as the shape of toner particles approach spheres. As a result, the transported amount becomes unstable. Such a problem can be suppressed by making all toner particles shapeless, but this causes reductions in fluidity and transfer efficiency and changes in chargeability and fluidity with time due to external additive's migrating and embedding into depressions of the toner particles.

Proposals have been made to obtain a developer satisfying all the requirements for fluidity, chargeability, transportability, and transfer properties by regulating the range of the shape of toner particles. For example, JP-A-61-279864 discloses a toner, shape of which is limited so that the median of the shape index may fall within a specific range. However, even with the regulated median of the shape index, sufficient transfer efficiency cannot be secured if shapeless toner particles exceed a certain proportion. Where the shapeless particles have small size, transfer becomes more difficult.

JP-A-1-185654 teaches that the rise in toner charging and charge distribution can be sharpened by regulating the relationship between the median of the shape of a toner and that of a carrier. Taking into account the distribution of the particle diameter and particle shape, however, sufficient transfer efficiency applicable to a cleanerless system cannot be obtained if the content of small and shapeless toner particles exceeds a certain proportion. In addition, insufficient cleaning and transport are caused.

Hence, it has been proposed to regulate the proportion of nearly spherical particles in number and the proportion of shapeless particles in number to improve cleanability, developing properties, and image quality (see JP-A-6-148926 and JP-A-6-148941). Further, JP-A-8-328312 proposes achieving both desired transfer properties and image quality by making black toner particles more shapeless than the other three color toners while making the other three color toners spherical. However, transfer properties change depending not only on shape but also on size. That is, small diameter toner particles and shapeless toner particles are hard to transfer due to strong electrostatic adhesion to a photoreceptor. Therefore, if the shapeless particles have a small diameter, sufficient transfer efficiency for application to a cleanerless system cannot be obtained even though the proportion of the number of the shapeless particles is reduced.

On the other hand, in order to cope with high-speed and large number of sheets copying systems while fulfilling the recent demand for color printing, especially on-demand color printing, a system comprising forming a multi-color image on a transfer belt and transferring and fixing the multi-color image onto an image fixing material at a time has been reported (see JP-A-8-115007).

Taking the step of transferring a toner image from a photoreceptor to a transfer belt as first transfer and the step of transferring the multi-color image from the transfer belt to an image fixing material as second transfer, there remains an untransferred toner in both the first and second transfer steps, which reduces the overall transfer efficiency and, of course, necessitates a cleaning step.

Particularly in the second transfer step, where a multi-color image is transferred all at once, and the image fixing material varies, for example in the case of paper, in terms of its thickness and surface properties, it has now been an outstanding subject to improve transfer properties and cleanability of an untransferred remaining toner. In this connection, the shape of a toner has been attempted to be controlled in order to improve its fluidity, chargeability, transportability, transfer properties, and cleanability. For example, to make toner particles spherical or nearly spherical has been proposed so as to improve fluidity, chargeability, and transfer properties, but cleanability is reduced as toner particles approach spheres. While a cleanerless system has been proposed as described above, in which a residual toner is recovered simultaneously with development while bringing the transfer efficiency as close to 100% as possible, this system is difficult to apply to full color printing because four color toners would be mixed with each other.

Further, with the spread of color printers based on electrostatic latent image development, it has been desired for the printers to be applicable to not only specific paper for exclusive use but a variety kinds of paper. When common paper is used, there are tendencies that paper dust remains on a photoreceptor to interfere with latent image formation or enters a developing unit to reduce the developing performance, leading to image missing.

Since sufficient cleanability cannot be secured simply by regulating the median of a shape index, regulating the proportion of nearly spherical particles in number has been proposed (see JP-A-6-148926 and JP-A-6-148941). However, transfer properties change not only with shape but also with size as previously stated. Therefore, a toner should be designed with due consideration for both of particle shape and size in order to obtain sufficient cleanability while securing satisfactory transfer properties.

SUMMARY OF THE INVENTION

An object of the present invention is to provide a toner for electrostatic latent image development which satisfies the requirements of fluidity, chargeability, developing properties and transfer properties over an extended period of time and, which eliminates the disadvantages particularly associated with a system where a cleaning step is omitted and an untransferred remaining toner is recovered simultaneously with development.

Another object of the present invention is to provide a developer for electrostatic latent image development which contains the above toner.

A further other object of the present invention is to provide a toner for electrostatic latent image development which eliminates the disadvantages associated with a multicolor image simultaneous transfer system adopted to development, transfer and cleaning so as to cope with the demands for high-speed and large number of sheets copying and high image quality.

A still other object of the present invention is to provide a developer for electrostatic latent image development which contains the above toner.

A yet further object of the present invention is to provide an image forming method which makes it possible to produce a large number of high quality prints at a high speed.

As a result of extensive investigation, the inventors of the present invention have found that the above objects are accomplished by a toner and a developer in which toner particles have a number average particle diameter of from 3 to 10 $\mu$m, and the size distribution and the shape index of the toner particles fulfill a specific relationship. The present invention has been completed based on this finding.

That is, the present invention relates to a toner for electrostatic latent image development, which comprises toner particles comprising a binder resin and a colorant, wherein said toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side.

The toner according to the present invention, in a first aspect, is for use in an apparatus adopting a cleanerless system, and said toner particles satisfy relationship (1). The toner in the first aspect preferably has an average shape index of 105 to 145.

The toner according to the present invention, in a second aspect, is for use in an apparatus adopting a blade cleaning system, and said toner particles satisfy relationship (2). The toner in the second aspect preferably has an average shape index of 110 to 145.

The present invention also relates to a developer for electrostatic latent image development, which comprises:

a carrier; and a toner which comprises toner particles comprising a binder resin and a colorant, wherein said toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side.

The developer according to the present invention, in a first aspect, is for use in an apparatus adopting a cleanerless system and said toner particles satisfy relationship (1).

The developer according to the present invention, in a second aspect, is for use in an apparatus adopting a blade cleaning system and said toner particles satisfy relationship (2).

The carrier used in the first and second aspect developers preferably has a resin coat.

The present invention further relates to an image forming method comprising the steps of:

(i) forming a latent image on a latent image holding member;

(ii) developing said latent image with a developer comprising a toner to form a toner image; and (iii) transferring said toner image to a receiving member, wherein said toner comprises toner particles comprising a binder resin and a colorant, and wherein said toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side.

In a first aspect of the image forming method according to the present invention, said toner particles satisfy relationship (1), and an untransferred remaining toner is recovered simultaneously with the development.

In a second aspect of the image forming method according to the present invention, said toner particles satisfy relationship (2), and a toner remaining on the latent image holding member is cleaned off by blade cleaning.

The toners according to the present invention satisfy all the requirements of fluidity, chargeability, developing properties, and transfer properties over an extended period of time. In particular, the first aspect toner for use in a cleanerless system eliminates the outstanding problems arising from untransferred remaining toner particles, and the second aspect toner eliminates the outstanding problems associated with blade cleaning when applied to a multi-color image transfer system of development, transfer and cleaning which meets the demands for producing a large number of copies and for high image quality. Therefore, the developer of the present invention comprising the toner of the present invention makes it possible to form a large number of prints with high image quality at a high speed.

DETAILED DESCRIPTION OF THE INVENTION

The terminology "average shape index" used for toner particles means a value, $ML^2/A$, calculated according to the following equation:

$$ML^2/A=(\text{maximum length})^2\times\pi\times100/(\text{area}\times4)$$

In the case of a complete sphere, the average shape index $ML^2/A$ is 100. In practice, an average shape index can be obtained by inputting the image of a toner under an optical microscope into an image analyzer (LUZEX III manufactured by Nireco Corporation), measuring the circle-equivalent diameters, and calculating $ML^2/A$ for every particle from its maximum length and area.

The first aspect toner, which satisfies relationship (1), i.e., $M_{50}(b)>M_{50}(c)>M_{50}(c)$, and preferably has an average shape index of 105 to 145, provides a developer counterbalancing the disadvantages of shapeless particles and spherical particles while taking full advantage of both types of particles. As to fluidity, spherical particles act as a fluidity assistant, compensating for the poor fluidity of shapeless particles and for the change of the state of adhesion of an external additive to shapeless particles, and nearly spherical particles retain satisfactory fluidity over a prolonged period of time because they scarcely have depressions into which an external additive, such as a fluidity imparting agent, may fall or buried by mechanical impact. Additionally, nearly spherical particles undergo less change in chargeability and maintain stable chargeability for a long time.

As for transfer properties, large diameter particles and nearly spherical particles have weak adhesion to a photoreceptor and are transferred easily. In the first aspect toner, shapeless particles have a relatively large diameter and are transferred easily. Even small diameter particles can be transferred easily by making their shape near to spheres. Having a nearly spherical shape, small diameter particles hardly cause external additives, such as an agent for imparting chargeability, an agent for imparting fluidity, and an agent for imparting transfer properties, to fall into depressions thereof or be buried therein by mechanical shock in a developing unit and therefore maintain satisfactory transfer properties for a prolonged period of time.

Further, since small diameter and spherical toner particles have weak adhesion to a photoreceptor and hardly cause changes with time of external additives, cleanability in a developing unit is improved so that a non-recovered toner remaining on a photoreceptor, if any, does not deteriorate image quality.

With regard to chargeability, large diameter particles have a reduced probability of contact with a carrier or a sleeve so that they produce an extremely small charge quantity per unit weight, showing a broad charge distribution. As a result, they tend to cause selective development. Now by making the shape of small diameter particles near to a sphere, the probability of contact with a carrier can be increased over that of shapeless particles thereby narrowing the charge distribution. Further by making the shape spherical, the non-static adhesion to a carrier or a sleeve is diminished thereby achieving development even if the charge quantity is smaller than that of shapeless particles. Thus, occurrence of selective development can be suppressed by controlling the shape and size distribution according to the present invention.

With reference to image quality, fine line reproducibility and edge reproducibility are improved by reducing the particle diameter and making the particles spherical, but particle diameter reduction leads to reduction in transfer efficiency, and making the particles spherical results in increase in rate of change of the amount of a developer transported with the change of the distance between a magnetic roll and a transport control plate, which makes the amount of transport instable. The control on the shape and size distribution according to the present invention makes it possible to provide a developer which comprises small diameter and spherical toner particles and yet exhibits stable transportability and excellent performance in transfer and reproduction of fine lines and edges. That is, there is provided a developer which is excellent in image quality, fluidity, transfer properties and suitability to a cleanerless system.

The second aspect toner, which satisfies relationship (2), i.e., $M_{50}(b)<M_{50}(c)<M_{50}(c)$, and preferably has an average shape index of 110 to 145, provides a developer which counterbalances the disadvantages of shapeless particles and spherical particles while taking full advantage of both particles. As to fluidity, relatively large diameter particles, whose shape is nearly spherical, act as a spacer, compensating for the poor fluidity of shapeless particles and preventing the external additives from changing the state of adhesion to the shapeless particles. Nearly spherical particles retain satisfactory fluidity over a prolonged period of time because they scarcely have depressions into which external additives such as an agent for imparting fluidity may fall or be buried by mechanical impact. Additionally, nearly spherical particles undergo less change in chargeability and maintain stable chargeability for a long time.

As for transfer properties, relatively large diameter and nearly spherical particles have weak adhesion to a photoreceptor or a transfer belt and are transferred easily. It is a generally observed phenomenon that shapeless particles cause external additives, such as an agent for imparting chargeability, an agent for imparting fluidity, and an agent for imparting transfer properties, to migrate into depressions thereof or be buried therein by mechanical impact in a developing unit and therefore impair transfer properties. In the present invention, because the relatively large particles have a nearly spherical shape, they function as a spacer effective in preventing such a phenomenon thereby maintaining the transfer properties for a long period of time.

As for cleanability, large diameter particles and spherical particles, both having weak adhesion to a photoreceptor or a transfer belt, are transferred easily, and shapeless particles remaining on a photoreceptor or a transfer belt can easily be cleaned off with a rubber-made cleaning blade. If any particles having a relatively nearly spherical shape remain non-transferred and forwarded to the cleaning step, they are hardly deposited on the cleaning blade because toner particles which shape is relatively close to shapeless and a small diameter act like abrasive grains.

With regard to chargeability, since large diameter particles have a reduced probability of contact with a carrier or a sleeve, they produce an extremely small charge quantity per unit weight with a broad charge distribution. As a result, selective development tends to occur. By making the shape of large diameter particles near to a sphere, the probability of contact with a carrier can be increased over that of shapeless particles thereby narrowing the charge distribution. Further by making the shape spherical, the non-static adhesion to a carrier or a sleeve is diminished thereby achieving development even if the charge quantity is smaller than that of shapeless particles. Thus, occurrence of selective development can be suppressed by controlling the shape and size distribution according to the present invention.

With reference to image quality, to reduce the particle diameter and to make the particles spherical bring about improvement in fine line reproducibility and edge reproducibility but make it more difficult to satisfy both the requirements of cleanability and transfer properties. That is, large diameter particles tend to be transferred selectively, while small diameter toner particles, which are less cleanable, tend to remain on a photoreceptor. In the present invention, since the toner particles have such a shape distribution that those particles having a relatively small diameter are shapeless, such small particles can be cleaned off with ease even if large diameter particles are transferred selectively. Thus, there is provided a developer excellent in image quality, cleanability, and transfer properties.

The toner of the present invention comprises a binder resin and a colorant and has a number average particle diameter of from 3 to 10 $\mu$m. The first aspect toner which satisfies relationship (1) preferably has an average shape index ($ML^2/A$) of 105 to 145. The second aspect toner which satisfies relationship (2) preferably has an average shape index of 110 to 145.

Where the average shape index is smaller than 110, the shape distribution is substantially very narrow, and there are scarcely any particles having a shape index of 130 or more, tending to fail to produce desired effects of the invention. On the other hand, it is practically difficult to produce toner particles having an average shape index greater than 145 by conventional processes. If produced by an emulsion polymerization and flocculation process, toner particles having an average shape index greater than 145 have very weak fusion bonding strength and are liable to destruction by mechanical stress in a developing unit or other units. They may be seen as effective in the initial stage of use but fail to continue manifesting their effects in the course of time.

The production process of the toner according to the present invention is not particularly limited as far as the above-described shape and size conditions are fulfilled. The toner can be made up of a single kind or two or more kinds which have different average particle diameters or average shape indices or are produced by different processes and combined so as to have the size and shape distribution satisfying relationship (1) or (2).

While not limiting, the toner satisfying relationship (1) can be obtained by, for example, mixing large diameter and shapeless particles and small diameter and spherical particles, and the toner satisfying relationship (2) can be obtained by, for example, mixing large diameter and spherical particles and small diameter and shapeless particles.

Processes for preparing the toner include: a kneading and grinding process which comprises kneading a binder, a colorant and, if necessary, additives, such as a release agent and a charge control agent, grinding the blend, followed by classification; a process comprising giving a mechanical impact or heat energy to the particles obtained by the kneading and grinding process to alter their shape; an emulsion polymerization and flocculation process consisting of emulsion polymerizing a monomer(s) to prepare a binder resin emulsion, mixing the emulsion with a dispersion of a colorant and necessary additives, causing the particles to flocculate and fuse thermally to obtain toner particles; a suspension polymerization process consisting of polymerizing a solution of a monomer(s) providing a binder resin, a colorant, and necessary additives as suspended in an aqueous medium; and a dissolution suspension process comprising suspending a solution of a binder resin, a colorant and necessary additives in an aqueous medium followed by granulation. The toner can have a core/shell structure, which is obtained by further adhering and fusion bonding flocculated particles to core particles prepared by any of the above-mentioned processes.

Examples of the binder resin for use in the present invention include homo- and copolymers of styrene, styrene derivatives, such as chlorostyrene, olefins, such as ethylene, propylene, butylene and isoprene, vinyl esters, such as vinyl acetate, vinyl propionate, vinyl benzoate, and vinyl butyrate, $\alpha$-methylene aliphatic monocarboxylic acid esters, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers, such as vinyl methyl ether, vinyl ethyl ether, and vinyl butyl ether, and vinyl ketones, such as vinyl methyl ketone, vinyl hexyl ketone, and vinyl isopropenyl ketone. Typical examples of these binder resins are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Additional examples of useful binder resins include polyester, polyurethane, epoxy resins, silicone resins, polyamide, modified rosin, and paraffin wax.

Examples of the colorant for use in the present invention typically include magnetic powders, such as magnetite and ferrite, carbon black, Aniline Blue, Chalcoyl Blue, Chrome Yellow, Ultramarine Blue, Du Pont Oil Red, Quinoline Yellow, Methylene Blue chloride, Phthalocyanine Blue, Marachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

If desired, the toner can contain known charge control agents. Suitable charge control agents include azo type metal complex compounds, metal complex compounds of salicylic acid, and polar group-containing resin type charge control agents. In preparing the toner in a wet process, it is preferred to use sparingly water-soluble materials from the standpoint of ionic strength controllability and reduction of water pollution.

If desired, the toner can contain waxes, such as low-molecular polypropylene and low-molecular polyethylene, as an offset inhibitor. The toner may be either a magnetic toner containing a magnetic material or a nonmagnetic toner containing no magnetic material.

It is essential for the toner to have a number average particle diameter ranging from 3 to 10 μm, preferably 4 to 8 μm. If the number average particle diameter exceeds 10 μm, the toner fails to develop a dot and line latent image with fidelity only to have inferior reproducibility of a photographic image or fine lines. If the number average particle diameter is smaller than 3 μm, the surface area per unit weight is too large to form a stable image with difficulty in controlling chargeability and fluidity.

According to the end use, the toner particles can have inorganic fine particles as an external additive adhered thereto. Inorganic fine particles known as an external additive for a toner, such as silica, alumina, titania, calcium carbonate, magnesium carbonate, calcium phosphate, and cerium oxide, can be used. If necessary, the inorganic fine particles can be surface-treated in a usual manner.

The developer according to the present invention may be either a one-component developer mainly composed of the above-described toner or a two-component developer composed of the toner and a carrier. Known carriers can be used in the two-component developer with no particular limitation. For example, a resin-coated carrier comprising a carrier core and a resin coat is preferably used. A carrier comprising a matrix resin having electrically conductive powder dispersed therein is also useful.

The coating resin and the matrix resin used for carriers include polyethylene, polypropylene, polystyrene, polyacrylonitrile, polyvinyl acetate, polyvinyl alcohol, polyvinyl butyral, polyvinyl chloride, polyvinylcarbazole, polyvinyl ether, polyvinyl ketone, a vinyl chloride-vinyl acetate copolymer, a styrene-acrylic acid copolymer, a straight silicone resin comprising an organosiloxane bond or modified products thereof, fluororesins, polyester, polyurethane, polycarbonate, phenolic resins, amino resins, melamine resins, benzoguanamine resins, urea resins, polyamide, and epoxy resins.

Useful electrically conductive materials include metals, such as gold, silver and copper, titanium oxide, zinc oxide, barium sulfate, aluminum borate, potassium titanate, tin oxide, and carbon black.

Useful carrier cores include magnetic metals, such as iron, nickel, and cobalt, magnetic oxides, such as ferrite and magnetite, and glass beads. In order to adjust the volume resistivity in a magnetic brush development system, the carrier core is preferably made of a magnetic material. The carrier core generally has an average diameter of 10 to 500 μm, preferably 30 to 100 μm.

The resin-coated carrier is prepared by immersing core particles in a coating resin solution (immersion method), spraying core particles with a coating resin solution (spray method), spraying fluidized core particles with a coating resin solution (fluidized bed method), or mixing core particles and a coating resin solution in a kneader coater while evaporating the solvent (kneader coater method).

The developer of the present invention is useful in an image forming method consisting of developing an electrostatic latent image formed on a latent image holding member with a developer layer formed on a developer carrier. The image forming method according to the present invention comprises the steps of forming a latent image on a latent image holding member, developing the latent image with a developer, and transferring the formed toner image to a receiving material. The latent image holding member includes an electrophotographic photoreceptor, a dielectric recording material, and the like, on which an electrostatic latent image is formed through a conventional process. The developer carrier includes, for example, a rotatable nonmagnetic sleeve having in the inside thereof a magnetic role. The developer carrier is disposed to face the latent image holding member. The toner image formed on the latent image holding member by development is then transferred to a receiving material through a known process and fixed thereon by a heat roll.

Where the first aspect toner of the invention is used, the image forming method does not include a cleaning step after transfer, and the toner remaining on the latent image holding member is recovered simultaneously with development. Where the second aspect toner is used, the residual toner remaining on the latent image holding member after transfer step is removed by blade cleaning. Where a transfer belt is used, a residual toner on the transfer belt is similarly cleaned off with a cleaning blade after the second transfer step.

Where the second aspect toner is used, it is preferable that the transfer step be carried out by forming a toner image once on a transfer belt as a first receiving material and then transferring the toner image from the transfer belt to a second receiving material. The transfer belt is usually a film support having thereon coated a coating resin layer having dispersed therein a resistance adjusting material. The transfer belt may have a seam, but a seamless belt is preferred.

The present invention will now be illustrated in greater detail with reference to the following Examples, but should not be construed as being limited thereto. Unless otherwise noted, all the parts and percents are by weight. $D_{50}$ means 50 percent diameter on a number basis.

I. Preparation of Toner A

| | |
|---|---|
| Linear styrene-n-butyl acrylate polymer (Tg: 58° C.; Mn: 4,000; Mw: 24,000) | 100 parts |
| Carbon black (Mogal L, produced by Cabot G.L. Inc.) | 3 parts |

The above components were kneaded in an extruder, ground in a jet mill, and classified with an air classifier to obtain black toner particles having $D_{50}$ of 5.0 μm, $M_{50}$(a) of 139.8, $M_{50}$(b) of 140.7, $M_{50}$(c) of 141.0, and $ML^2/A$ of 140.5.

The toner particles were blended with 0.65% silica (R972, produced by Nippon Aerosil Co., Ltd.) in a Henschel mixer to obtain a black toner (designated toner A).

II. Preparation of Toner B

II-1. First Step

II-1-1. Preparation of Resin Dispersion (1):

| | |
|---|---|
| Styrene | 370 g |
| n-Butyl acrylate | 30 g |
| Acrylic acid | 8 g |
| Dodecanethiol | 24 g |
| Carbon tetrabromide | 4 g |

The above components were mixed and dissolved. The mixture was emulsified in a flask containing a solution of 6 g of a nonionic surface active agent (Nonipol 400, produced by Sanyo Chemical Industries, Ltd.) and 10 g of an anionic surface active agent (Neogen SC, produced by Dai-ich Kogyo Seiyaku Co., Ltd.) in 550 g of ion-exchanged water.

While stirring the emulsion slowly for 10 minutes, ion-exchanged water weighing 50 g and having 4 g of ammonium persulfate dissolved therein was poured into the flask. After displacing the atmosphere with nitrogen, the contents of the flask were heated on an oil bath with stirring till the temperature reached 70° C. The emulsion polymerization was continued at that temperature for 5 hours to obtain resin dispersion (1) having dispersed therein resin particles having an average particle diameter of 155 nm, Tg of 59° C., and Mw of 12,000.

II-1-2. Preparation of Resin Dispersion (2):

| | |
|---|---|
| Styrene | 280 g |
| n-Butyl acrylate | 120 g |
| Acrylic acid | 8 g |

The above components were mixed and dissolved. The mixture was emulsified in a flask containing a solution of 6 g of a nonionic surface active agent (Nonipol 400) and 12 g of an anionic surface active agent (Neogen SC) in 550 g of ion-exchanged water. Ion-exchanged water weighing 50 g and having 3 g of ammonium persulfate dissolved therein was poured into the flask while slowly stirring for 10 minutes. After displacing the atmosphere with nitrogen, the contents of the flask were heated on an oil bath with stirring till the temperature reached 70° C. The emulsion polymerization was continued at that temperature for 5 hours to obtain resin dispersion (2) having dispersed therein resin particles having an average particle diameter of 105 nm, Tg of 53° C., and Mw of 550,000.

II-1-3. Preparation of Colorant Dispersion (1):

| | |
|---|---|
| Carbon black (Mogal L) | 50 g |
| n-Butyl acrylate (Nonipol 400) | 5 g |
| Ion-exchanged water | 200 g |

The above components were mixed and dissolved, and the mixture was dispersed in a homogenizer (Ultratarax T50, manufactured by IKA) for 10 minutes to prepare colorant dispersion (1) comprising carbon black particles having an average particle diameter of 250 nm dispersed therein.

II-1-4. Preparation of Release Agent Dispersion (1):

| | |
|---|---|
| Paraffin wax (HNP0190, produced by Nippon Seiro Co., Ltd.; melting point: 85° C.) | 50 g |
| Cationic surface active agent (Sanizol B50, produced by Kao Corp.) | 5 g |
| Ion-exchanged water | 200 g |

The above components were heated to 95° C., and the mixture was dispersed in a homogenizer (Ultratarax T50, manufactured by IKA) and then in a pressure homogenizer to prepare release agent dispersion (1) having release agent particles having an average particle diameter of 550 nm dispersed therein.

II-2. Second Step

II-2-1. Preparation of Flocculated Particles:

| | |
|---|---|
| Resin dispersion (1) | 120 g |
| Resin dispersion (2) | 80 g |
| Color dispersion (1) | 200 g |
| Release agent dispersion (1) | 40 g |
| Cationic surface active agent (Sanizol B50) | 1.5 g |

The above components were put in a round flask made of stainless steel and mixed and dispersed by means of a homogenizer (Ultratarax T50, manufactured by IKA). The flask was heated to 50° C. on an oil bath while stirring. After keeping the dispersion at 45° C. for 20 minutes, microscopic observation of the dispersion revealed formation of flocculated particles having an average particle diameter of about 4.0 μm.

II-2-2. Adhesion of Resin to Particles:

Resin dispersion (1) weighing 60 g (total volume of the dispersed resin particles was 25 $cm^3$) was slowly added to the dispersion obtained in II-2-1 above, and the temperature of the oil bath was raised to 50° C., at which the mixture was maintained for 30 minutes. Adhesion of flocculated particles to the original flocculated particles to increase the average particle diameter to about 4.8 μm was confirmed under observation with an optical microscope.

II-3. Third Step

To the dispersion obtained in II-2-2 above was added 3 g of an anionic surface active agent (Neogen SC), and the stainless steel-made flask was closed. The contents were heated up to 105° C. while stirring by means of a magnetic seal, at which temperature the contents were kept for 4 hours. After cooling, the reaction product was collected by filtration, washed thoroughly with ion-exchanged water, and dried to obtain a black toner having $D_{50}$ of 5.0 μm, $M_{50}$(a) of 140.6, $M_{50}$(b) of 103.8, $M_{50}$(c) of 102.7, and $ML^2/A$ of 103.5.

The toner particles were blended with 0.65% silica (R972, produced by Nippon Aerosil Co., Ltd.) in a Henschel mixer to obtain a black toner (designated toner B).

III. Preparation of Toner C

Toner C was prepared in the same manner as for toner B with the following exceptions. In the step of preparing flocculated particles, the mixture in the flask was kept at 45° C. for 20 minutes to obtain flocculated particles having an average particle diameter of 3.8 μm. In the step of adhering particles, the mixture was maintained at 50° C. for 30 minutes to obtain flocculated particles having an average particle diameter of about 4.9 μm. In the third step, the contents of the flask were maintained at 93° C. for 5 hours to obtain a black toner having $D_{50}$ of 5.1 μm, $M_{50}$(a) of 123.2, $M_{50}$(b) of 133.8, $M_{50}$(c) of 119.8, and $ML^2/A$ of 125.8.

The toner particles were blended with 0.65% silica (R972, produced by Nippon Aerosil Co., Ltd.) in a Henschel mixer to obtain black toner C.

IV. Preparation of Toner D

Toner D was prepared in the same manner as for toner B with the following exceptions. In the step of preparing flocculated particles, the mixture in the flask was kept at 50° C. for 30 minutes to obtain flocculated particles having an average particle diameter of 6.5 μm. In the step of adhering particles, the mixture was maintained at 50° C. for 30 minutes to obtain adhering particles having an average particle diameter of about 7.3 μm. In the third step, the contents of the flask were maintained at 93° C. for 3 hours to obtain a black toner having $D_{50}$ of 7.5 μm, $M_{50}$(a) of 135.4, $M_{50}$(b) of 139.6, $M_{50}$(c) of 125.8, and $ML^2/A$ of 133.0.

The toner particles were blended with 0.43% silica (R972, produced by Nippon Aerosil Co., Ltd.) in a Henschel mixer to obtain black toner D.

V. Preparation of Toner E

Toner E was prepared in the same manner as for toner B with the following exceptions. In the step of preparing flocculated particles, the mixture in the flask was kept at 45° C. for 30 minutes to obtain flocculated particles having an average particle diameter of 5.5 μm. In the step of adhering particles, the mixture was maintained at 50° C. for 30 minutes to obtain flocculated particles having an average particle diameter of about 6.4 μm. In the third step, the contents of the flask were maintained at 105° C. for 3.5 hours to obtain a black toner having $D_{50}$ of 6.5 μm, $M_{50}$(a) of 118.2, $M_{50}$(b) of 120.8, M50(c) of 116.3, and $ML^2/A$ of 118.5.

The toner particles were blended with 0.50% silica (R972, produced by Nippon Aerosil Co., Ltd.) in a Henschel mixer to obtain black toner E.

EXAMPLE 1

Toner A and toner B were blended at a weight ratio of 1:1. The toner blend was added to a ferrite carrier coated with 1% polymethyl methacrylate (produced by Soken Kagaku) and having an average particle diameter of 50 μm, so as to give a total toner concentration of 5%, and mixed in a twin-cylinder mixer to prepare a two-component developer.

EXAMPLE 2

A developer was prepared in the same manner as in Example 1, except for changing the ratio of toner A to toner B into 1:3.

COMPARATIVE EXAMPLE 2

A developer was prepared in the same manner as in Comparative Example 1, except for using toner B.

The size and shape characteristics of the toner in the developers prepared in Examples 1 to 4 and Comparative Examples 1 and 2 are shown in Table 1 below.

TABLE 1

| | Color | $D_{50}$ | $M_{50}$(a) | $M_{50}$(b) | $M_{50}$(c) | $ML^2/A$ |
|---|---|---|---|---|---|---|
| Example 1 | B | 6.3 | 124.9 | 145.8 | 105.8 | 125.3 |
| Example 2 | B | 6.0 | 119.8 | 142.4 | 104.3 | 123.2 |
| Example 3 | B | 6.3 | 127.8 | 137.8 | 118.6 | 126.3 |
| Example 4 | B | 6.5 | 118.2 | 120.8 | 116.3 | 118.5 |
| Compara. Example 1 | B | 5.0 | 139.8 | 140.7 | 141.0 | 140.5 |
| Compara. Example 2 | B | 5.0 | 104.6 | 103.8 | 102.7 | 103.5 |

A copying test was carried out using the developers prepared on a copier (A-Color, produced by Fuji Xerox Co., Ltd., modified to omit the cleaning step) to obtain 50,000 copies in a black-and-white mode. The results of the test are shown in Table 2, in which SAD stands for an image density (hereinafter the same).

TABLE 2

| | Initial | | | After 50,000 Copies | | |
|---|---|---|---|---|---|---|
| | SAD (B) | Image Quality | Transfer Efficiency (%) | SAD (B) | Image Quality | Transfer Efficiency (%) |
| Example 1 | 1.52 | no problem | 95.2 | 1.50 | no problem | 93.9 |
| Example 2 | 1.45 | no problem | 98.1 | 1.43 | no problem | 97.2 |
| Example 3 | 1.46 | no problem | 94.2 | 1.42 | no problem | 90.4 |
| Example 4 | 1.47 | no problem | 97.4 | 1.44 | no problem | 95.0 |
| Compara. Example 1 | 1.56 | streaks due to insufficient removal of residual toner | 85.6 | 1.20 | external additive buried in toner surface, reduction in density due to shortage of charge quantity, and streaks due to residual toner | 72.2 |
| Compara. Example 2 | 1.42 | no problem | 98.6 | 1.25 | scattering of carrier due to overfeed of developer, and reduction in density and dropping of toner due to shortage of charge quantity | 95.5 |

EXAMPLE 3

A developer was prepared in the same manner as in Example 1, except for replacing toners A and B with toners C and D, respectively.

EXAMPLE 4

A developer was prepared in the same manner as in Example 1, except for replacing the blend of toners A and B with toner E.

COMPARATIVE EXAMPLE 1

Toner A was added to a ferrite carrier coated with 1% polymethyl methacrylate (produced by Soken Kagaku) and having an average particle diameter of 50 μm, so as to give a toner concentration of 5%, and mixed in a twin-cylinder mixer to prepare a two-component developer.

As is apparent from the above results, the developers of Examples 1 to 4 showed satisfactory performance in terms of image density, image quality, and transfer efficiency and maintained the performance over the testing period. The developer of Comparative Example 1 had a low transfer efficiency and developed streaks due to insufficient removal of the residual toner from the photoreceptor from the initial stage. A noticeable reduction in density occurred due to shortage of the charge quantity after obtaining 50,000 copies, when the external additive particles were found buried in the surface of the toner particles in a micrograph. The developer of Comparative Example 2 exhibited satisfactory performance in density, image quality and transfer efficiency in the initial stage but encountered difficulty in adjusting the amount to be transferred by means of the transport control plate, showing liability to overfeed. After obtaining 50,000 copies, scatter of the carrier particles on the photoreceptor due to the overfeed was observed, which accompanied development of scratches on the photoreceptor, partial missing of the image, and reduction in charge quantity.

VI. Preparation of Toner F

VI-1. Preparation of Toner F(B):

| | |
|---|---|
| Linear styrene/n-butyl acrylate copolymer (Tg: 58° C.; Mn: 4,000; Mw: 24,000) | 100 parts |
| Carbon black (Mogal L) | 3 parts |

The above components were kneaded in an extruder, ground in a jet mill, and classified through an air classifier to obtain black toner particles having $D_{50}$ of 5.0 μm, $M_{50}$(a) of 139.6, $M_{50}$(b) of 138.9, $M_{50}$(c) of 139.4, and $ML^2/A$ of 139.0.

The toner particles were blended with 0.68% silica (R972, produced by Nippon Aerosil Co., Ltd.) in a Henschel mixer to obtain a black toner (designated toner F(B)).

VI-2. Preparation of Toner F(C):

In the same manner as for toner F(B), except for replacing carbon black (3 parts) with 5 parts of C.I. Pigment Blue 15:3, toner F(C) having $D_{50}$ of 5.1 μm, $M_{50}$(a) of 139.7, $M_{50}$(b) of 139.0, $M_{50}$(c) of 139.5, and $ML^2/A$ of 139.6 was obtained.

VI-3. Preparation of Toner F(M):

In the same manner as for toner F(B), except for replacing carbon black (3 parts) with 6 parts of C.I. Pigment Red 112, toner F(M) having $D_{50}$ of 5.0 μm, $M_{50}$(a) of 138.6, $M_{50}$(b) of 139.1, $M_{50}$(c) of 139.2, and $ML^2/A$ of 139.4 was obtained.

VI-4. Preparation of Toner F(Y):

In the same manner as for toner F(B), except for replacing carbon black (3 parts) with 7 parts of C.I. Pigment Yellow 74, toner F(Y) having $D_{50}$ of 4.8 μm, $M_{50}$(a) of 139.5, $M_{50}$(b) of 138.2, $M_{50}$(c) of 139.5 and $ML^2/A$ of 139.0 was obtained.

VII. Preparation of Toner G

VII-1. Preparation of Toner G(B):

VII-1-1. First Step

Resin dispersions (1) and (2), colorant dispersion (1), and release agent dispersion (1) were prepared in the same manner as in the preparation of toner B.

VII-1-2. Second Step

VII-1-2-1. Preparation of Flocculated Particles

| | |
|---|---|
| Resin dispersion (1) | 120 g |
| Resin dispersion (2) | 80 g |
| Color dispersion (1) | 200 g |
| Release agent dispersion (1) | 40 g |
| Cationic surface active agent (Sanizol B50) | 1.5 g |

The above components were put in a round flask made of stainless steel and mixed and dispersed by means of a homogenizer (Ultratarax T50). The flask was heated to 50° C. on an oil bath while stirring. After keeping the dispersion at 50° C. for 40 minutes, microscopic observation of the dispersion revealed formation of flocculated particles having an average particle diameter of about 8 μm.

VII-1-2-2. Adhesion of Resin

Resin dispersion (1) weighing 60 g (total volume of the dispersed resin particles was 25 $cm^3$) was slowly added to the dispersion obtained in VII-1-2-1, and the temperature of the oil bath was raised to 50° C., at which the mixture was maintained for 1 hour. Adhesion of flocculated particles to the original flocculated particles to increase the average particle diameter to about 8.4 μm was confirmed under observation with an optical microscope.

VII-1-3. Third Step

To the dispersion obtained in VII-1-2 above was added 3 g of an anionic surface active agent (Neogen SC), and the stainless steel-made flask was closed. The contents were heated up to 105° C. while stirring by means of a magnetic seal, at which temperature the contents were kept for 3 hours. After cooling, the reaction product was collected by filtration, washed thoroughly with ion-exchanged water, and dried to obtain a black toner having $D_{50}$ of 8.5 μm, $M_{50}$(a) of 118.8, $M_{50}$(b) of 118.4, $M_{50}$(c) of 117.5, and $ML^2/A$ of 118.5.

The toner particles were blended with 0.40% silica (R972, produced by Nippon Aerosil Co., Ltd.) in a Henschel mixer to obtain a black toner (designated toner G(B)).

VII-2. Preparation of Toner G(C), Toner G(M) and Toner G(Y):

Cyan, magenta and yellow toners were prepared in the same manner as for toner G(B) except for changing the pigment in the same manner as for toner F(C), toner F(M) and toner F(Y), respectively. The size and shape characteristics of the resulting toners are shown in Table 3 below, in which B, C, M, and Y stand for black, cyan, magenta, and yellow, respectively (hereinafter the same).

VIII. Preparation of Toner H

Toner H(B) was prepared in the same manner as for toner G(B) with the following exception. In the step of preparing flocculated particles, the mixture in the flask was kept at 45° C. for 20 minutes to obtain flocculated particles having an average particle diameter of 4 μm. In the step of adhering resin to flocculated particles, the mixture was maintained at 50° C. for 30 minutes to obtain flocculated particles having an average particle diameter of about 4.8 μm. In the third step, the contents of the flask were maintained at 93° C. for 3 hours. The resulting toner particles had $D_{50}$ of 5.1 μm, $M_{50}$(a) of 140.2, $M_{50}$(b) of 144.0, $M_{50}$(c) of 137.8, and $ML^2/A$ of 139.0. The toner particles were blended with 0.67% silica (R972, produced by Nippon Aerosil Co., Ltd.) in a Henschel mixer.

Cyan, magenta and yellow toners (toner H(C), toner H(M), and toner H(Y)) were prepared in the same manner as for toner H(B) except for changing the pigment in the same manner as for toner F(C), toner F(M) and toner F(Y), respectively. The size and shape characteristics of the resulting toners are shown in Table 3.

IX. Preparation of Toner I

Toner I(B) was prepared in the same manner as for toner G(B) with the following exception. In the step of preparing flocculated particles, the mixture in the flask was kept at 50° C. for 30 minutes to obtain flocculated particles having an average particle diameter of 6.5 μm. In the step of adhering resin to flocculated particles, the mixture was maintained at 50° C. for 30 minutes to obtain flocculated particles having an average particle diameter of about 7.3 μm. In the third step, the contents of the flask were maintained at 93° C. for 6 hours. The resulting toner particles had $D_{50}$ of 7.5 μm, $M_{50}$(a) of 120.0, $M_{50}$(b) of 123.2, $M_{50}$(c) of 118.7, and $ML^2/A$ of 121.0. The toner particles were blended with 0.45% silica (R972, produced by Nippon Aerosil Co., Ltd.) in a Henschel mixer.

Toner I(C), toner I(M), and toner I(Y) were prepared in the same manner as for toner I(B), except for changing the pigment in the same manner as for toner F(C), toner F(M) and toner F(Y), respectively. The size and shape characteristics of the resulting toners are shown in Table 3.

X. Preparation of Toner J

Toner J(B) was obtained in the same manner as for toner G(B). Further, toner J(C), toner J(M), and toner J(Y) were prepared in the same manner as for toner F. The size and shape characteristics of the resulting toners are shown in Table 3.

TABLE 3

| Toner | Color | $D_{50}$ | $M_{50}(a)$ | $M_{50}(b)$ | $M_{50}(c)$ | $ML^2/A$ |
|---|---|---|---|---|---|---|
| F | Y | 4.8 | 139.5 | 138.2 | 139.5 | 139.0 |
| | M | 5.0 | 138.6 | 139.1 | 139.2 | 139.4 |
| | C | 5.1 | 139.7 | 139.0 | 139.5 | 139.6 |
| | B | 5.0 | 139.6 | 138.9 | 139.4 | 139.0 |
| G | Y | 8.5 | 119.1 | 118.0 | 117.3 | 118.1 |
| | M | 8.6 | 119.2 | 118.1 | 117.1 | 118.1 |
| | C | 8.5 | 119.2 | 118.8 | 116.9 | 118.9 |
| | B | 8.5 | 118.8 | 118.4 | 117.5 | 118.5 |
| H | Y | 5.2 | 140.3 | 144.0 | 137.2 | 139.1 |
| | M | 5.0 | 140.5 | 144.3 | 137.7 | 139.3 |
| | C | 5.0 | 140.1 | 144.2 | 137.5 | 139.7 |
| | B | 5.1 | 140.2 | 144.0 | 137.8 | 139.0 |
| I | Y | 7.6 | 120.0 | 123.5 | 118.9 | 121.2 |
| | M | 7.4 | 119.8 | 125.4 | 118.8 | 120.7 |
| | C | 7.5 | 119.5 | 127.0 | 118.5 | 120.5 |
| | B | 7.5 | 120.0 | 123.2 | 118.7 | 121.0 |
| J | Y | 5.0 | 138.6 | 140.0 | 141.5 | 140.9 |
| | M | 5.1 | 139.5 | 141.5 | 141.5 | 140.8 |
| | C | 5.0 | 139.0 | 139.8 | 140.9 | 140.0 |
| | B | 5.0 | 139.8 | 140.7 | 141.0 | 140.5 |

EXAMPLE 5

Toner F(B) and toner G(B) were blended at a weight ratio of 1:1. The toner blend was added to a ferrite carrier coated with 1% polymethyl methacrylate (produced by Soken Kagaku) and having an average particle diameter of 50 $\mu$m, so as to give a total toner concentration of 5%, and mixed in a twin-cylinder mixer to prepare a developer (designated developer (B)).

Similarly developers (C), (M) and (Y) were prepared by using the other color toners F and G.

EXAMPLE 6

Color developers were prepared in the same manner as in Example 5, except for changing the ratio of toner F to toner G into 4:1.

EXAMPLE 7

Color developers were prepared in the same manner as in Example 5, except for replacing toners A and B with toners H and I, respectively.

EXAMPLE 8

Color developers were prepared in the same manner as in Example 7, except for changing the ratio of toner H to toner I into 1:4.

COMPARATIVE EXAMPLE 3

Toner G was added to a ferrite carrier coated with 1% polymethyl methacrylate (produced by Soken Kagaku) and having an average particle diameter of 50 $\mu$m, so as to give a toner concentration of 5%, and mixed in a twin-cylinder mixer to prepare three color developers.

COMPARATIVE EXAMPLE 4

Color developers were prepared in the same manner as in Comparative Example 3, except for using toner J.

The size and shape characteristics of the toner in the developers prepared in Examples 5 to 8 and Comparative Examples 3 and 4 are shown in Table 4 below.

TABLE 4

| | Color | $D_{50}$ | $M_{50}(a)$ | $M_{50}(b)$ | $M_{50}(c)$ | $ML^2/A$ |
|---|---|---|---|---|---|---|
| Example 5 | Y | 6.7 | 130.2 | 126.0 | 134.0 | 130.5 |
| | M | 6.7 | 132.5 | 127.1 | 136.2 | 132.6 |
| | C | 6.6 | 130.9 | 126.8 | 133.9 | 131.1 |
| | B | 6.8 | 129.9 | 125.5 | 134.2 | 130.0 |
| Example 6 | Y | 5.9 | 125.0 | 120.2 | 137.3 | 126.2 |
| | M | 5.8 | 126.4 | 119.7 | 137.8 | 126.4 |
| | C | 5.8 | 125.8 | 120.4 | 133.9 | 126.0 |
| | B | 5.9 | 126.9 | 120.9 | 136.4 | 127.0 |
| Example 7 | Y | 6.3 | 128.4 | 124.7 | 136.0 | 130.0 |
| | M | 6.3 | 128.5 | 123.3 | 135.8 | 129.5 |
| | C | 6.3 | 127.2 | 124.6 | 134.3 | 127.2 |
| | B | 6.2 | 128.0 | 125.1 | 135.9 | 128.5 |
| Example 8 | Y | 7.0 | 124.6 | 123.1 | 137.2 | 125.7 |
| | M | 7.1 | 124.5 | 122.9 | 137.6 | 125.9 |
| | C | 7.2 | 123.7 | 121.9 | 136.5 | 124.3 |
| | B | 6.9 | 123.4 | 120.8 | 138.0 | 124.6 |
| Compara. Example 3 | Y | 8.5 | 118.0 | 119.1 | 117.3 | 118.1 |
| | M | 8.6 | 118.1 | 119.2 | 117.1 | 118.1 |
| | C | 8.5 | 118.8 | 119.2 | 116.9 | 118.9 |
| | B | 8.5 | 118.4 | 118.8 | 117.5 | 118.5 |
| Compara. Example 4 | Y | 5.0 | 138.6 | 140.0 | 141.5 | 140.9 |
| | M | 5.1 | 139.5 | 141.5 | 141.5 | 140.8 |
| | C | 5.0 | 139.0 | 139.8 | 140.9 | 140.0 |
| | B | 5.0 | 139.8 | 140.7 | 141.0 | 140.5 |

A color copying test was carried out using the four color developers prepared in Examples and Comparative Examples on a copier (A-Color 635, produced by Fuji Xerox Co., Ltd., modified in such a manner that a toner image was successively transferred to a transfer belt, the full color image thus formed on the transfer belt was transferred to paper all at once, the transfer belt was then cleaned with a urethane resin-made blade, and the processing speed was elevated to produce 50 copies of 4A size per minute) to obtain 50,000 copies in a full color (inclusive of black) mode. The results of the test are shown in Table 5.

TABLE 5

| | Initial | | | | | After 50,000 Copies | | | | |
|---|---|---|---|---|---|---|---|---|---|---|
| | SAD (B) | SAD (C + M + Y) | Image Quality | Clean-ability | Transfer Effi-ciency (%) | SAD (B) | SAD (C + M + Y) | Image Quality | Clean-ability | Transfer Effi-ciency (%) |
| Example 5 | 1.50 | 1.62 | no problem | no problem | 88.2 | 1.49 | 1.57 | no problem | no problem | 85.3 |
| Example 6 | 1.48 | 1.59 | no problem | no problem | 86.1 | 1.53 | 1.58 | no problem | no problem | 80.9 |

TABLE 5-continued

| | Initial | | | | | After 50,000 Copies | | | | |
|---|---|---|---|---|---|---|---|---|---|---|
| | SAD (B) | SAD (C + M + Y) | Image Quality | Clean-ability | Transfer Effi-ciency (%) | SAD (B) | SAD (C + M + Y) | Image Quality | Clean-ability | Transfer Effi-ciency (%) |
| Example 7 | 1.45 | 1.53 | no problem | no problem | 90.2 | 1.45 | 1.56 | no problem | no problem | 86.4 |
| Example 8 | 1.42 | 1.54 | no problem | no problem | 87.4 | 1.40 | 1.55 | no problem | no problem | 82.0 |
| Compara. Example 3 | 1.52 | 1.59 | no problem | toner slightly remained unremoved | 97.3 | 1.25 | 1.27 | streaks and white dots due to insufficient cleaning, scattering of carrier due to developer overfeed, and dropping of toner | consid-erable insuffi-ciency of cleaning | 88.2 |
| Compara. Example 4 | 1.40 | 1.49 | no problem | no problem | 85.0 | 1.25 | 1.25 | external additive buried in toner surface, and reduction in density due to shortage of charge quantity | no problem | 55.7 |

As is apparent from the above results, the developers of Example 5 to 8 showed satisfactory performance in terms of image density, image quality, and transfer efficiency and maintained the performance over the testing period. The developer of Comparative Example 3 suffered from instability of transport in the developing unit from the initial stage. After obtaining 50,000 copies, scattering of the carrier on the photoreceptor was observed, which accompanied scratches on the photoreceptor, image missing, and reduction in charge quantity. Further, the toner adhered to the cleaning blade to impair the cleaning performance, which resulted in development of streaks on the image. The developer of Comparative Example 4 exhibited satisfactory performance in density, image quality and transfer efficiency in the initial stage. However, it suffered from reduction in image density due to shortage of charge quantity after obtaining 50,000 copies, when the toner particles were observed under FE-SEM to have the external additive particles buried on the surface thereof. Further, the developer of Comparative Example 4 had poor transfer efficiency over the whole testing period.

While the invention has been described in detail and with reference to specific examples thereof, it will be apparent to one skilled in the art that various changes and modifications can be made therein without departing from the spirit and scope thereof.

What is claimed is:

1. A toner for electrostatic latent image development, which comprises toner particles comprising a binder resin and a colorant, wherein said toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side.

2. The toner according to claim 1, wherein said toner is for use in an apparatus adopting a cleanerless system, and said toner particles satisfy relationship (1).

3. The toner according to claim 2, wherein said toner particles have an average shape index of 105 to 145.

4. The toner according to claim 1, wherein said toner is for use in an apparatus adopting a blade cleaning system, and said toner particles satisfy relationship (2).

5. The toner according to claim 4, wherein said toner particles have an average shape index of 110 to 145.

6. The toner according to claim 4, wherein said toner is for use in full color image formation.

7. A developer for electrostatic latent image development, which comprises:

a carrier; and a toner which comprises toner particles comprising a binder resin and a colorant, wherein said toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side.

8. The developer according to claim 7, wherein said developer is for use in an apparatus adopting a cleanerless system, and said toner particles satisfy relationship (1).

9. The developer according to claim 8, wherein said carrier has a resin coat.

10. The developer according to claim 8, wherein said toner particles have an average shape index of 105 to 145.

11. The developer according to claim 7, wherein said developer is for use in an apparatus adopting a blade cleaning system, and said toner particles satisfy relationship (2).

12. The developer according to claim 11, wherein said carrier has a resin coat.

13. The developer according to claim 11, wherein said toner particles have an average shape index of 110 to 145.

14. An image forming method comprising the steps of:

(i) forming a latent image on a latent image holding member;

(ii) developing said latent image with a developer comprising a toner to form a toner image; and (iii) transferring said toner image to a receiving member, wherein said toner comprises toner particles comprising a binder resin and a colorant, and wherein said toner particles have a number average particle diameter of from 3 to 10 $\mu$m and satisfy relationship (1) or (2):

$$M_{50}(b)>M_{50}(a)>M_{50}(c) \quad (1)$$

$$M_{50}(b)<M_{50}(a)<M_{50}(c) \quad (2)$$

wherein $M_{50}(a)$ is an average shape index at a number average particle diameter $D_{50}$ which is calculated from cumulative 50% particles counting from the larger diameter side, $M_{50}(b)$ is an average shape index at a number average particle diameter $D_{16}$ which is calculated from cumulative 16% particles counting from the larger diameter side, and $M_{50}(c)$ is an average shape index at a number average particle diameter $D_{84}$ which is calculated from cumulative 84% particles counting from the larger diameter side.

15. The image forming method according to claim 14, wherein said toner particles satisfy relationship (1), and wherein an untransferred remaining toner is recovered simultaneously with said development.

16. The image forming method according to claim 14, wherein said toner particles satisfy relationship (2), and wherein a toner remaining on the latent image holding member is cleaned off by blade cleaning.

17. The image forming method according to claim 16, wherein said transferring step (iii) comprises:

first transfer step of transferring the toner image onto a first receiving member comprising a transfer belt; and second transfer step of transferring said toner image on the first receiving member onto a second receiving member.

18. The image forming method according to claim 16, wherein said developer is a full color developer and a multi-color image is formed.

* * * * *